United States Patent [19]

Elsbett

[11] Patent Number: 4,895,111

[45] Date of Patent: Jan. 23, 1990

[54] ENGINE COOLING SYSTEM

[76] Inventor: Ludwig Elsbett, Industriestrasse 14, 8543 Hilpolstein, Fed. Rep. of Germany

[21] Appl. No.: 230,671

[22] Filed: Aug. 5, 1988

Related U.S. Application Data

[63] Continuation of Ser. No. 790,996, Oct. 24, 1985, abandoned, which is a continuation-in-part of Ser. No. 710,864, Mar. 12, 1985, Pat. No. 4,715,335.

[51] Int. Cl.[4] ..... F01P 1/04

[52] U.S. Cl. ..... 123/41.35

[58] Field of Search ..... 123/41.35, 41.36, 41.39, 123/41.42, 41.74, 41.85, 195 R, 41.72

[56] References Cited

U.S. PATENT DOCUMENTS

| | | | |
|---|---|---|---|
| 2,085,810 | 7/1937 | Ljungstrom | 123/41.42 |
| 3,115,125 | 12/1963 | Spencer et al. | 123/41.42 |
| 3,127,879 | 4/1964 | Giacosa et al. | 123/41.42 |
| 3,939,807 | 2/1976 | Eichinger | 123/41.72 X |
| 4,114,571 | 9/1978 | Ruf | 123/41.35 |
| 4,129,108 | 12/1978 | Elsbett et al. | 123/41.35 |
| 4,377,967 | 3/1983 | Pelizzoni | 123/41.35 X |
| 4,523,557 | 6/1985 | Fox | 123/195 R X |
| 4,621,595 | 11/1986 | Suzuki | 123/41.72 |
| 4,715,335 | 12/1987 | Elsbett et al. | 123/41.35 |

*Primary Examiner*—Noah P. Kamen

*Attorney, Agent, or Firm*—Peter K. Kontler

[57] ABSTRACT

An inner/outer cooling system for the cylinder of a piston combustion engine is provided by inner oil cooling and only the top part of the cylinder which is not reached by the inner cooling is cooled also by oil from the outside. The single steps are given by a special piston construction in a special very heat-sealed combustion system and through a special distribution of the cool oil spray in the combustion cylinder working.

4 Claims, 2 Drawing Sheets

ENGINE COOLING SYSTEM

This application is a continuation of U.S. patent application Ser. No. 790,996, filed 10/24/1985, now abandoned, which is a continuation-in-part of Ser. No. 710,864, filed 3/12/1985, now U.S. Pat. No. 4,715,335.

Inner and outer cooling system for combustion engines are known wherein oil is sprayed against the inside of a cylinder wall and that around the outer wall of the cylinder are arranged either cooling ribs for direct air cooling or a water jacket for indirect cooling.

For better economical utilization of the fuel and warm air, it is preferable to only cool the areas on which a film of oil must adhere in order to give the piston the necessary sliding and gas sealing function that is needed for troublefree operation of the combustion engine. This suggests that actually only the inner side of the cylinder need be cooled and only those areas where the inner wall cannot be reached by the sprayed oil. Outer cooling is also necessary to absorb heat from the cylinder wall, so that the oil film on the cylinder wall does not overheat. It would also be beneficial to ensure that the least possible heat flows into the cylinder from the hot cylinder head.

In the preferred embodiment the objects of the invention are fulfilled in that in most of the cylinder no outer cooling is provided, instead the cooling of the piston sliding surface is carried out by an oil sprayer within the cylinder which either sprays and cools the wall directly, or else indirectly removes the heat from the sliding surface of the cylinder over the sprayed sole plate of the piston. For this purpose, a divided piston is used of which the sliding surface part with the sole plate of curved deflectors for the oil spray is manufactured from heat conducting material, and of which the upper part of the combustion area in form and material carries out the least possible heat conduction. Therefore, it consists of an iron alloy and has only a narrow connecting bridge between the piston floor and the sealed jacket that slides against the cylinder surface. The usual connection between the piston combustion zone and the piston rings is removed.

The cylinder surface not reached by the oil sprayer or by the inner cooling on the upper part of the cylinder is kept possibly small in that the height of the sealed jacket i.e. piston skirt is shortened, in order that the difference in heat dissipation between the cylinder and the piston becomes reduced through material and form of the piston's upper portion. A small expandable gap between the piston and the cylinder allows provision for fewer piston rings and a smaller sealing jacket height. On these grounds are presented a cooling system in combination with the known steel joint piston.

In a preferred arrangement the cylinder wall's uppermost part where it is hottest can be cooled from the outside.

The heat flow from the cylinder head to the cylinder is also reduced in that there is a cooling jacket around the area where the cylinder touches the cylinder head which cools off the cylinder head material at this point.

The rest of the temperature balance between the cylinder and the cylinder head is achieved through direct contact so that the usual cylinder head seal is not needed. This is possible especially because the same engine oil is used for cooling both for outside as well as inside. Cool oil instead of cool water does have less specific heat, however, it possesses a higher boiling point and is not harmed by a gas leak from the combustion zone.

Because of this arrangement, we achieve that up to now in those areas that because of the sealing plate from the head and the cylinder were not cooled, especially not well cooled and in those places in the cylinder that up to now were over cooled, namely the whole bottom portion of the cylinder can now be less cooled and therefore the inner oil spray is sufficient.

With respect to the cooling then heating, results in the combining of the cooling system with the combustion process. For the above-mentioned cooling system we recommend a combustion room so that between the combustion zone and the combustion area wall there can circulate an air pocket that does not contribute to the combustion. Thus the obtained cooling/heating can be reduced.

BRIEF DESCRIPTION OF THE DRAWINGS

FIG. 1 - shows a cylinder (1) with a divided or articulated piston (2) which includes a piston sole plate. (3). The two components i.e. the piton (2) at sole plate (3) are connected together by a pin (not shown). This sole plate is comprised of curved deflectors (4) for the deflection of the oil spray (5) within the cylinder, the heat is absorbed or extracted from the sliding surface (6) of the cylinder (1) by contact with the cool oil spray and passed inwardly. The area that is reached by the oil spray includes the piston jacket (7) in the upper dead end zone or chamber (8) of the cylinder. The area of the sliding or lubricated surface not reached by the cool oil spray gets cooled by an outer oil jacket (9). In order to reduce the heat from the combustion area (10) to the sliding surface (8), a narrow passage (11) is provided in front of the piston sealing jacket (7) and is the only connection provided between the combustion area (10) and the piston sealing jacket (7). The heat flow that passes the narrow passage is so little that the sealing jacket surface area (13) of the top part of the piston rings (12) can lie so close to the cylinder (1) that it can be drawn near for the cooling of the cylinder sliding surface section (8). Due to the movement of the piston (2) from the top to the bottom of the cylinder, heat gets drawn out of the upper area of the cylinder (8) to the lower area of the cylinder over this narrow sealing jacket area. The heat flow out of the cylinder head (14) into the cylinder (1) is reduced in that the outer cooling jacket (9) is extended into the cylinder head (14) up to the height of the valve seat rings (15). On this cooled surface (8), due to the cooling jacket (9), sits the cylinder head (14) directly (without a cylinder head seal) on top of the cylinder (1), such that a heat balance results between the cylinder head (14) and the cylinder (1).

Figure 1:
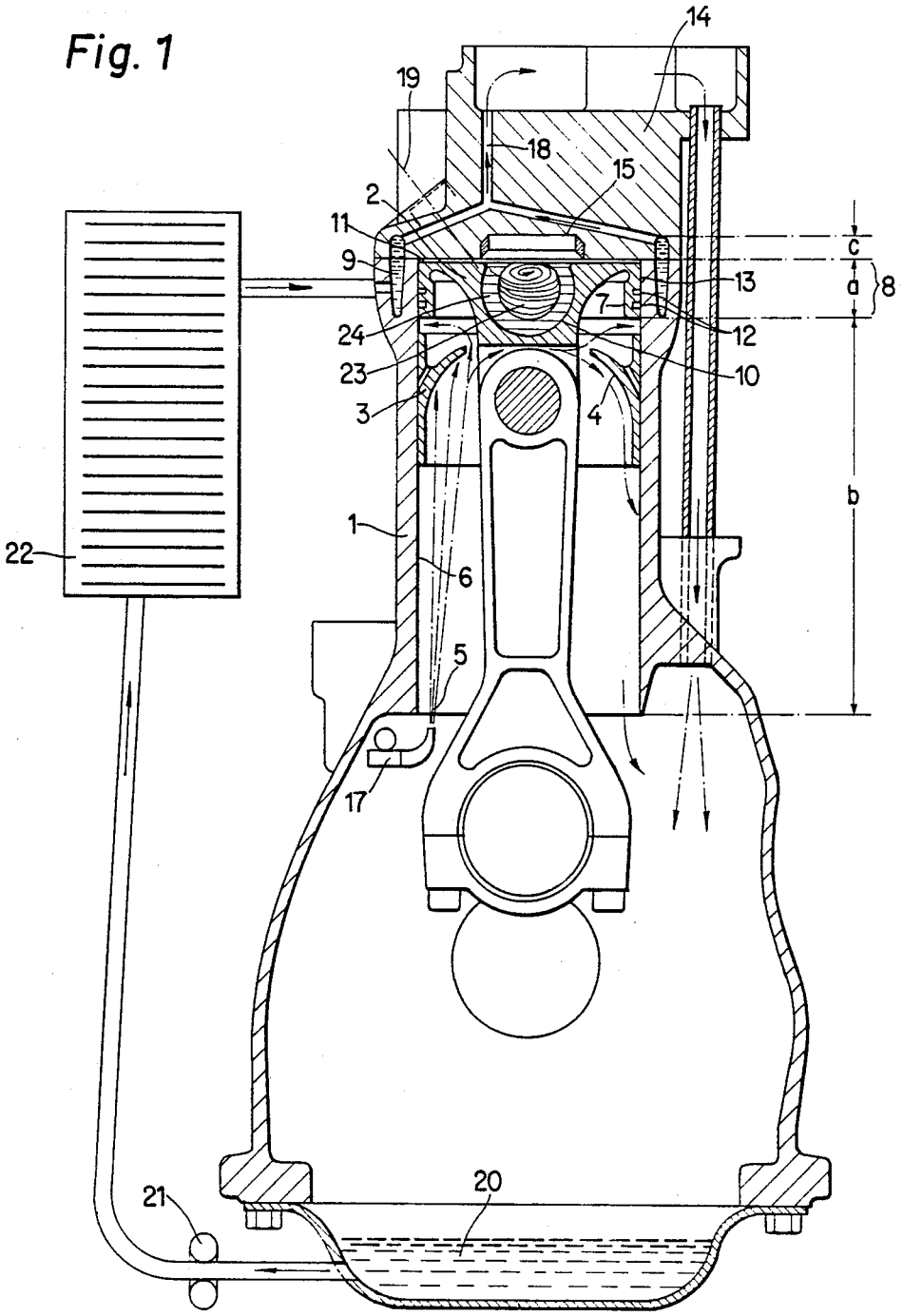
FIG. 1 shows a oil cooling system with a piston having a sole plate.

With the length (a) the distance is given that is provided for the outer cooling of the cylinder. The length (a) conforms to the height of the sealing jacket (8) with respect to the piston (2). It can therefore be all the shorter the lower the sealing jacket (8). Preferably this is achieved with the articulated steelpoint piston (2) in that the connection to the lubricated sliding surface (3) of the cylinder is interrupted. The length (b) describes the inner cooling length that is reached by the oil spray (5) of the oil sprayer (7). (a) and (b) together give the length 2 of the cylinder (1). The distance (c) describes the length with which the outer oil jacket (9) is contained within the cylinder head (14).

Figure 2:
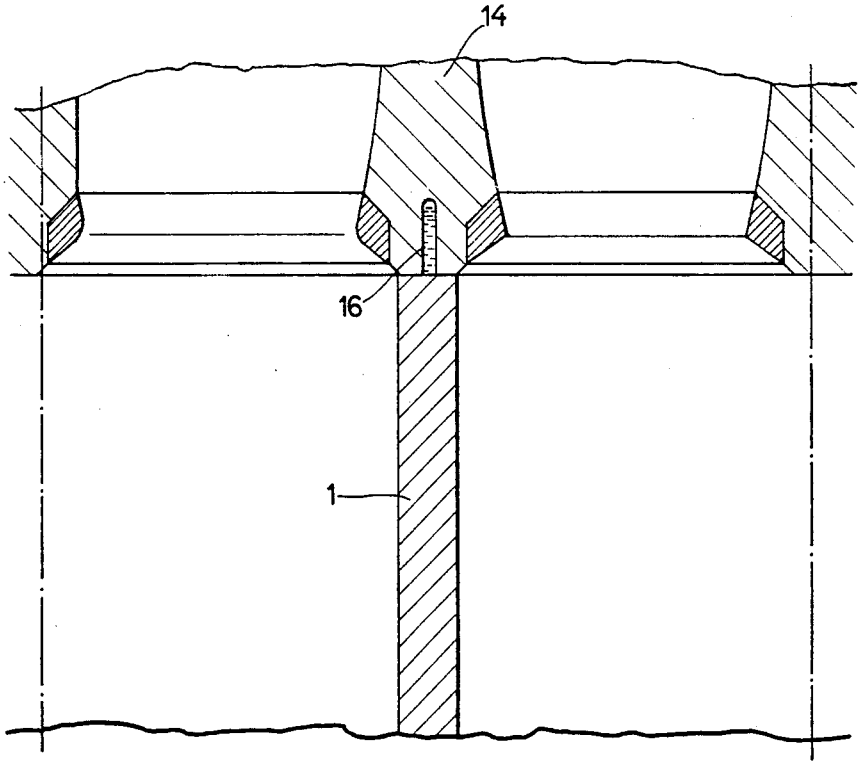
FIG. 2 shows an oil cooled cylinder head.

FIG. 2 - in the places in which the cylinders (1) are cast together (FIG. 2), is provided a cavity or slit (16) in the cylinder head (14) that approximates the distance (c). As cooling jacket in the aforementioned arrangement oil is used as well as the cooling substance for outer cooling which in its reverse flow (18) in FIG. 1, by the sprayer feeder (19), is joined with the lubricating oil in the common oil pan (20). From there it is directed by the pump (21) to the oil cooler (22). The material preferably used for the cylinder (1), the upper piston (2) and the cylinder head (14) is cast iron or other iron alloys that conduct less heat than aluminum. Only for the sole plate (3) with the curved deflectors onto which the oil sprays (5) is directed is aluminum more advantageous because the heat flow does not go (as is usual up to now) from the piston (2) to the cylinder (1), but in this invention from the cylinder sliding surface (6) by way of the oil-cooled sole plate (3).

In order to keep the cooling system heat so low that the inner oil spray cooling as well as a small outer oil cooling is also enough for high cylinder performance, is provided a combustion process in which the hot combustion area (23) is separated by a circulation cold air jacket (24) from the combustion zone wall (10).

What I claim is:

1. A lubricant-cooled internal combustion engine comprising a cylinder block having a bore with an open first end and a second end, and an internal surface surrounding said bore; a cylinder head closing said first end; a hollow piston reciprocable in said bore to and from a position adjacent said first end, said piston including a crown defining a combustion chamber confronting said cylinder head, and a skirt coupled to said crown and having deflector means adjacent said internal surface, said cylinder block defining an annular passageway surrounding said first end and having a length at least approximating the axial length of said crown; means for circulating lubricant in said passageway; and means for spraying lubricant into said bore by way of said second end so that the thus sprayed lubricant impinges upon said internal surface and is thereupon deflected by said deflector means into the interior of said piston to cool the crown in the region of said combustion chamber, said skirt and said crown being spaced apart from each other in the region of said internal surface so that lubricant which is deflected into the interior of the piston is free to contact the internal surface between the crown and the skirt.

2. The engine of claim 1, wherein said skirt has at least one passagway leading from the interior of the piston to said internal surface so that lubricant which is deflected into the interior of the piston is free to contact the internal surface by way of the at least one passageway in the skirt.

3. The engine of claim 1, wherein the thermal conductivity of said skirt exceeds the thermal conductivity of said crown.

4. The engine of claim 1, wherein said cylinder head has an annular passageway communicating with the annular passageway of said cylinder block.

* * * * *